US009997126B2

(12) United States Patent
Kim et al.

(10) Patent No.: US 9,997,126 B2
(45) Date of Patent: Jun. 12, 2018

(54) DISPLAY DEVICE HAVING IMPROVED ELECTROMAGNETIC INTERFERENCE CHARACTERISTICS

(71) Applicant: Samsung Display Co., Ltd., Yongin-si, Gyeonggi-do (KR)

(72) Inventors: Min Woo Kim, Yongin-si (KR); Dong In Kim, Yongin-si (KR); Seong Hyun Go, Yongin-si (KR); On Sik Choi, Yongin-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 0 days. days.

(21) Appl. No.: 15/249,095

(22) Filed: Aug. 26, 2016

(65) Prior Publication Data

US 2017/0110078 A1 Apr. 20, 2017

(30) Foreign Application Priority Data

Oct. 16, 2015 (KR) ..... 10-2015-0144777

(51) Int. Cl.
*G09G 3/36* (2006.01)
*G09G 3/20* (2006.01)

(52) U.S. Cl.
CPC ..... *G09G 3/3685* (2013.01); *G09G 3/2096* (2013.01); *G09G 3/3674* (2013.01); *G09G 2310/0245* (2013.01); *G09G 2310/08* (2013.01); *G09G 2330/06* (2013.01)

(58) Field of Classification Search
CPC ..... G09G 2310/0245; G09G 2310/08; G09G 2330/06; G09G 3/2096; G09G 3/3674; G09G 3/3685; G09G 5/008; G09G 5/18; G09G 3/3611; G06F 3/1431; H04B 15/00; H04B 2215/065
See application file for complete search history.

(56) References Cited

U.S. PATENT DOCUMENTS 6,433,766 B1 * 8/2002 Chen ..... G09G 3/20 345/100
7,064,689 B2 6/2006 Hori
7,616,133 B2 11/2009 Hollis
(Continued)

FOREIGN PATENT DOCUMENTS

JP 2004-236019 A 8/2004
KR 10-2004-0044384 A 5/2004
KR 10-1125975 B1 3/2012

*Primary Examiner* — Hong Zhou
(74) *Attorney, Agent, or Firm* — Innovation Counsel LLP

(57) ABSTRACT

A display device includes a timing controller configured to receive an image data signal and a plurality of clock signals and to generate a scan clock signal and a plurality of data clock signals, a scan driver configured to receive the scan clock signal, and a data driver configured to receive the data clock signals. The clock signals include first to nth clock signals, and the data clock signals include first to nth data clock signals generated from the first to nth clock signals (n≥2), the first to nth clock signals having differing frequencies and the first to nth data clock signals having differing frequencies. Whenever a predetermined number of frame periods has elapsed, the timing controller halts transmission of one of the first to nth data clock signals to the data driver, and begins transmission of another one of the first to nth data clock signals thereto.

13 Claims, 4 Drawing Sheets

(56) References Cited

U.S. PATENT DOCUMENTS

| | | | | |
|---|---|---|---|---|
| 7,894,564 | B2 | 2/2011 | Hsiao-Chyi | |
| 2004/0223566 | A1 | 11/2004 | Yamashita | |
| 2009/0174691 | A1* | 7/2009 | Yeo | G09G 3/2096 345/204 |
| 2009/0284499 | A1* | 11/2009 | Kim | G09G 3/20 345/204 |
| 2011/0037758 | A1* | 2/2011 | Lim | H03L 7/0805 345/213 |
| 2012/0169686 | A1* | 7/2012 | Kim | G09G 3/2096 345/208 |
| 2012/0194488 | A1* | 8/2012 | Park | G09G 3/2096 345/204 |
| 2014/0184574 | A1* | 7/2014 | Shie | G09G 5/008 345/204 |

* cited by examiner

DISPLAY DEVICE HAVING IMPROVED ELECTROMAGNETIC INTERFERENCE CHARACTERISTICS

CROSS-REFERENCE TO RELATED APPLICATION

This application claims priority to, and the benefit of, Korean Patent Application No. 10-2015-0144777 filed on Oct. 16, 2015 in the Korean Intellectual Property Office, the entire contents of which are incorporated herein by reference in their entirety.

BACKGROUND

1. Field

Embodiments of the present invention relate generally to display devices. More specifically, embodiments of the present invention relate to display devices having improved electromagnetic interference characteristics.

2. Description of the Related Art

With the recent growth in digital home appliance markets and continuous increase in supply of personal portable communication terminals, display devices are required to be reduced in weight and power consumption, and various technologies for meeting such requirements have been proposed. In line with this, flat display devices such as a liquid crystal display (LCD), a plasma display panel (PDP), an organic electro-luminescence display (OLED), and the like, replacing the conventional cathode ray tubes (CRTs), have been developed and implemented.

The flat display devices include a timing controller for processing image data for driving a panel used to display received image data, and for generating a timing control signal. The devices also include a panel driving unit for driving the panel by using image data and a timing control signal transmitted from the timing controller.

In particular, recently, the use of a scheme for reducing electromagnetic interference (EMI) and transmitting data at a high speed has seen acceptance.

SUMMARY

An embodiment of the present invention relates to a display device for reducing an average radio frequency (RF) noise level by dispersing a frequency component corresponding to RF noise.

Another embodiment of the present invention relates to a display device for suppressing an increase in current consumption by preventing unnecessary data transmission for satisfying an RF noise standard.

A display device according to an embodiment of the present invention includes: a timing controller configured to receive an image data signal and a plurality of clock signals, and to generate a scan clock signal and a plurality of data clock signals; a scan driver configured to receive the scan clock signal; and a data driver configured to receive the data clock signals, wherein the plurality of clock signals includes first to nth clock signals, and the plurality of data clock signals includes first to nth data clock signals generated from the first to nth clock signals (n is a natural number having a value of 2 or greater), the first to nth clock signals having frequencies different from each other and the first to nth data clock signals having frequencies different from each other, and whenever a predetermined number of frame periods has elapsed, the timing controller halts transmission of one of the first to nth data clock signals to the data driver, and begins transmission of another one of the first to nth data clock signals to the data driver.

Each frame period may include a horizontal blank section that is a section during which effective image data is not transmitted between immediately successive scanning lines, and also includes a vertical blank section between immediately successive frame periods, wherein the timing controller may change the data clock signal in the vertical blank section.

The timing controller may further generate clock training data, and when the one of the data clock signals is generated from an ith clock signal (i is any one of a natural number from 1 to n), the timing controller may embed the ith clock signal in the clock training data and transmit the clock training data in the vertical blank section.

The ith data clock signal may be generated by embedding the ith clock signal in the image data signal.

When the predetermined number of frame periods has passed since the ith data clock signal was supplied to the data driver, the timing controller may transmit an (i+1)th data clock signal to the data driver, and when i=n, the timing controller may transmit the first data clock signal as the (i+1)th data clock signal.

When k times each of the first clock signal to the nth clock signal (k is a natural number having a value of 2 or greater) is displayed as a function of frequency and frequency components corresponding to the first clock signal to the nth clock signal are displayed as a spread spectrum having a predetermined band width, the timing controller may generate the first clock signal to the nth clock signal such that the frequency components corresponding to the first clock signal to the nth clock signal do not overlap each other.

A value obtained by k times a difference value between a frequency value of the first clock signal and a frequency value of the second clock signal may be equal to or greater than a value of the predetermined bandwidth.

A difference between a frequency value of the ith clock signal and a frequency value of the (i+1)th clock signal may remain uniform when i is changed.

The timing controller may transmit an (i+1)th data clock signal to the data driver upon passing of the predetermined number of frame periods, and the timing controller may transmit an (n−1)th data clock signal as the (i+1)th data clock signal when i=n.

When i=n and the (n−1) data clock signal is transmitted as the ith data clock signal, the timing controller may transmit the data clock signal such that the value i is sequentially decremented to 1.

A display device according to another embodiment of the present invention includes: a display panel including a plurality of pixels connected to scanning lines and data lines; a timing controller configured to receive an image data signal and a plurality of clock signals, and to generate and transmit a scan clock signal and a plurality of data clock signals; a scan driver configured to generate a scan signal with reference to the scan clock signal, and to supply the generated scan signal to the scanning lines; and a data driver configured to generate a data signal with reference to the data clock signals, and to supply the generated data signal to the data lines, wherein the plurality of clock signals includes first to nth clock signals, and the plurality of data clock signals includes first to nth data clock signals generated from the first clock signal to nth (n is a natural number having a value of 2 or greater) clock signals, and the timing controller is configured to change the data clock signal transmitted to the data driver whenever a predetermined number of frame periods has passed.

Each frame period may include a horizontal blank section that is a section during which effective image data is not transmitted between successive scanning lines, and a vertical blank section between immediately successive frame periods, wherein the timing controller may be configured to change the data clock signal in the vertical blank section.

The timing controller may further be configured to generate clock training data, and when the one of the data clock signals is generated from an ith clock signal (i is any one of a natural number from 1 to n), the timing controller may be configured to embed the ith clock signal in the clock training data and to transmit the clock training data in the vertical blank section.

When a data clock signal having a frequency value different from that of a data clock signal transmitted in a previous frame is input to the vertical blank section to cause an unlocked state, the data driver may be configured to recover the unlocked state to a locked state during the vertical blank section.

According to the embodiment of the present invention, it is possible to distribute frequency components corresponding to RF noise, and to thereby lower an average RF noise level, by using a plurality of clock signals having different frequency values for driving a display panel.

Also, according to the embodiment of the present invention, it is possible to restrain an increase in power consumption by preventing unnecessary data transmission, that is, by preventing an increase in a data rate, to satisfy an RF noise standard.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will full convey the scope of the example embodiments to those skilled in the art.

In the drawing figures, dimensions may be exaggerated for clarity of illustration. The various figures thus may not be to scale. It will be understood that when an element is referred to as being "between" two elements, it can be the only element between the two elements, or one or more intervening elements may also be present. Like reference numerals refer to like elements throughout.

DETAILED DESCRIPTION

Figure 1:
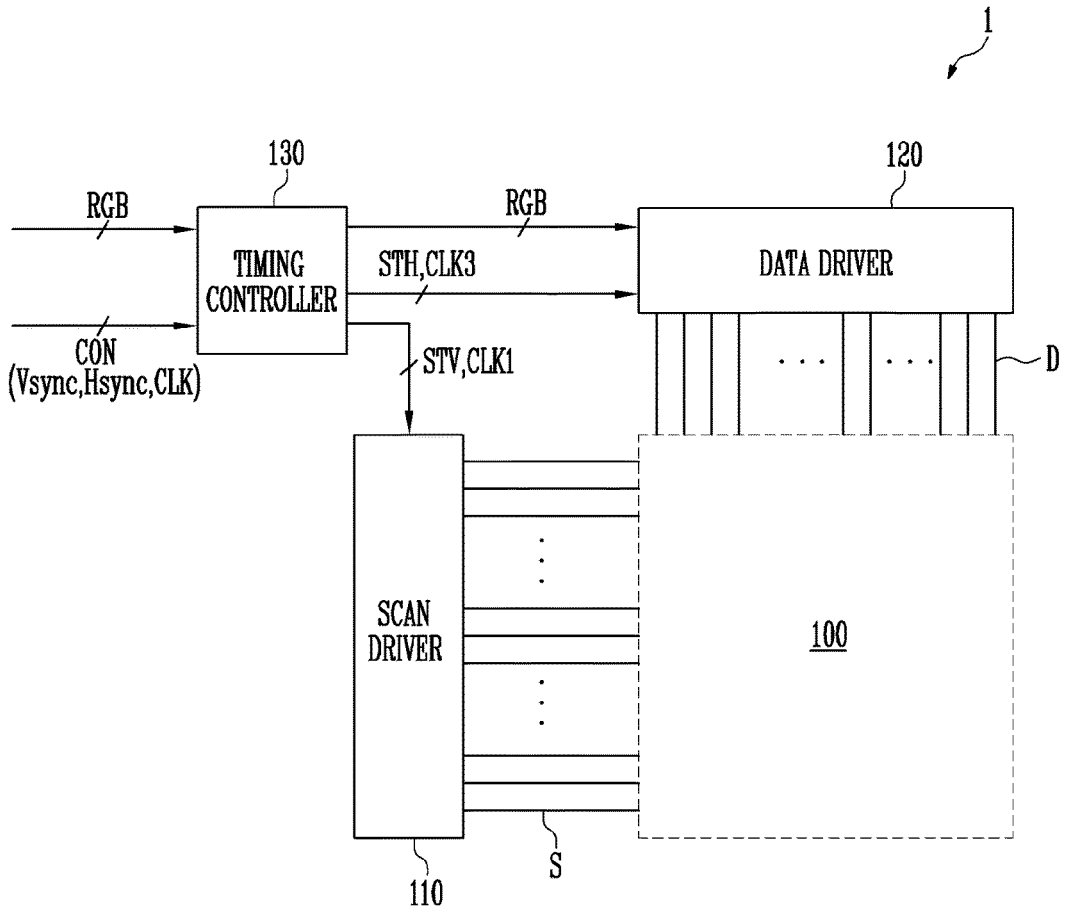
FIG. 1 is a view illustrating a display device according to an embodiment of the present invention.

Details of embodiments are included in the foregoing descriptions and associated drawings.

Advantages and features of the present invention, and implementation methods thereof will be clarified through following embodiments described with reference to the accompanying drawings. The present invention may, however, be embodied in different forms and should not be construed as limited to the embodiments set forth herein. Throughout this specification and the claims that follow, when it is described that an element is "connected" to another element, the element may be "directly connected" to the other element or "electrically connected" to the other element through a third element. In the accompanying drawings, a portion irrelevant to description of the present invention will be omitted for clarity. Like reference numerals refer to like elements throughout. All numerical values are approximate, and may vary. All examples of specific materials and compositions are to be taken as nonlimiting and exemplary only. Other suitable materials and compositions may be used instead.

Hereinafter, embodiments of the present invention will be described with reference to the accompanying drawings.

FIG. 1 is a view illustrating a display device according to an embodiment of the present invention.

Referring to FIG. 1, a display device 1 according to an embodiment of the present invention may include a pixel unit 100 including a plurality of pixels (not shown), a scan driver 110, a data driver 120, and a timing controller 130.

Also, the display device 1 according to an embodiment of the present invention may further include scanning lines S connected between the scan driver 110 and the pixels, and data lines D connected between the data driver 120 and the pixels.

The pixel unit 100 may refer to an effective display unit of a display panel. The display panel may include a thin film transistor (TFT) substrate and a color filter substrate, in known manner.

A liquid crystal layer is formed between the TFT substrate and the color filter substrate, the data lines D and the scanning lines S are formed on the TFT substrate, and a plurality of pixels may be disposed in regions outlined by the scanning lines D and the data lines D.

In response to a scan signal from the scanning line S, a TFT included in each of the pixels may transfer a voltage of a data signal supplied by way of the data line D to a liquid crystal capacitor (implemented as liquid crystal between a pixel electrode (not shown) and a common electrode formed on the TFT substrate).

For this purpose, a gate electrode of the TFT is connected to the scanning line S, and a first electrode of the TFT may be connected to the data line D. A second electrode of the TFT may be connected to a liquid crystal capacitor and a storage capacitor. Here, the storage capacitor is optional and may help to maintain a voltage of a data signal transferred to the pixel electrode for a predetermined period of time until a next data signal is supplied.

Meanwhile, the first electrode may be any one of a source electrode and a drain electrode of the TFT, and the second electrode may be an electrode different from the second electrode.

For example, when the first electrode is set as a source electrode, the second electrode may be set as a drain electrode.

In FIG. 1, for convenience, it is assumed that the display device is a liquid crystal display device, but the present invention is not limited thereto.

Next, in response to a data start signal (STH) and a data clock signal CLK3 provided from the timing controller 130, the data driver 120 may generate a data signal and supply the generated data signal to the data lines D.

The data driver 120 may restore the data clock signal CLK3 from image data RGB in which the data clock signal CLK3 obtained from the timing controller 130 is embedded, and for this purpose, a delay locked loop (DLL) or a phase locked loop (PLL) may be used.

Next, in response to the scan start signal STV and the scan clock signal CLK1, the scan driver 110 may generate a scan signal and output the scan signal to the scanning lines S.

For example, the scan driving unit 110 may sequentially supply a scan signal to the scanning lines S. When the scan signal is sequentially supplied to the scanning lines S, pixels may be selected in units of horizontal lines, and the pixels selected by the scanning line may receive a data signal.

The scan driving unit 110 may be implemented in the form of an amorphous silicon gate driver (ASG) on the display panel.

Also, the scan driver 110 may be mounted on both sides of the display panel with the pixel unit 100 interposed therebetween, or may be implemented on only one side, as shown in FIG. 1.

The timing controller 130 may receive image data RGB and a control signal CON from an external source.

The control signal CON may include a horizontal synchronization signal Hsync, a vertical synchronization signal Vsync, and a clock signal CLK.

The timing controller 130 may generate a data start signal STH using the horizontal synchronization signal Hsync, and output the data start signal STH to the data driver 120.

Also, the timing controller 130 may generate the scan start signal STV by using the vertical synchronization signal Vsync, and output the scan start signal STV to the scan driver 110.

Also, the timing controller 130 may generate a scan clock signal CLK1 and a data clock signal CLK3 by using the clock signal CLK.

For this purpose, the timing controller 130 may generate clock signals by using a DLL or PLL according to the clock signal CLK.

In particular, the timing controller 130 may provide an integration signal obtained by embedding the data clock signal CLK3 generated from the control signal CON in the image data signal RGB. This integration signal may be transmitted to the data driver 120.

Also, in order to allow the data driver 120 to more smoothly restore the clock signal CLK3 from the image data signal RGB in which the clock signal CLK3 is embedded, the timing controller 130 may transmit clock training data to the data driver 120 before transmitting the image data signal RGB. In this case, the clock training data may also have a predetermined clock signal embedded therein.

In the present disclosure, RF noise may be noise obtained by measuring a frequency component appearing in a frequency domain in a signal obtained from an antenna.

Also, when an RF noise value measured for a preset period of time (for example, 100 ms) is a first noise value, the RF noise may be obtained by measuring noise values a preset number of times (for example, 100 times), and averaging the results. This will be described in detail with reference to FIG. 2.

FIG. 2 is a view illustrating a method for measuring RF noise.

Graphs illustrated in FIGS. 2A-2F may be frequency domain graphs in which an x axis is frequency (Hz) and y axis is power (dBm).

Figure 2A:
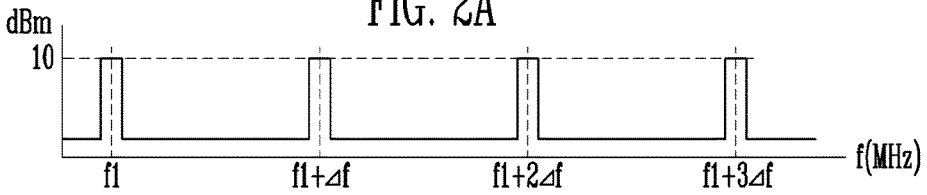
FIGS. 2A, 2B, 2C, 2D, 2E, and 2F are frequency domain graphs illustrating a method for measuring average RF noise.
Figure 2B:
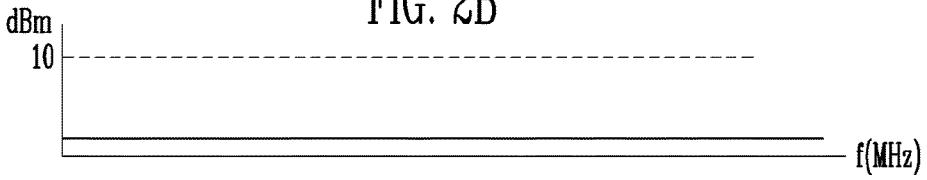
Figure 2C:
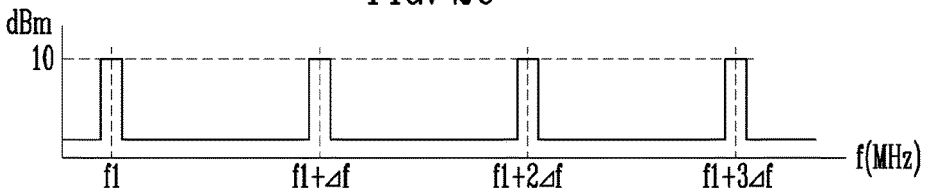
Figure 2D:
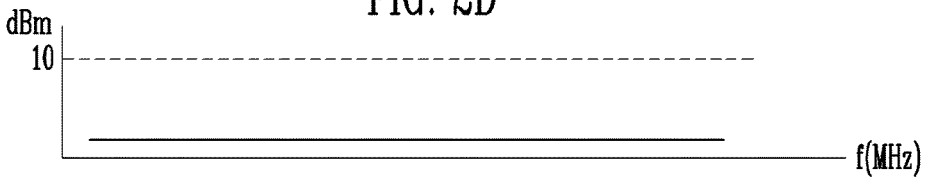
Figure 2E:
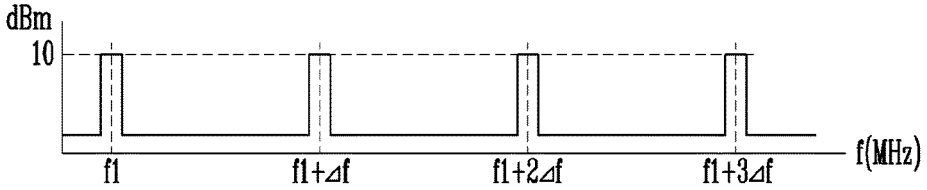

In FIG. 2, FIG. 2A may be a graph illustrating a frequency component corresponding to RF noise as a first RF noise measurement result, FIG. 2B may be a graph illustrating a frequency component corresponding to RF noise as a second RF noise measurement result, FIG. 2C may be a graph illustrating a frequency component corresponding to RF noise as a third RF noise measurement result, FIG. 2D may be a graph illustrating a frequency component corresponding to RF noise as a fourth RF noise measurement result, and FIG. 2E may be a graph illustrating a frequency component corresponding to RF noise as a fifth RF noise measurement result.

Meanwhile, RF noise may not be always generated in every measurement, and thus, it is assumed that a noise component is not detected in the second and fourth measurement results.

Figure 2F:
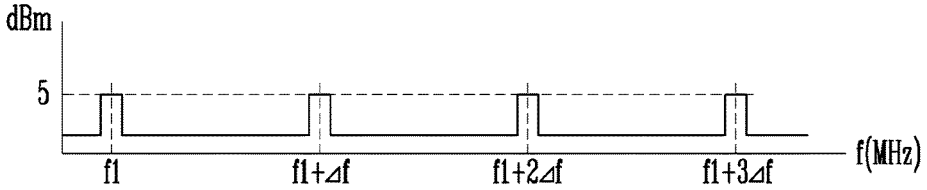

When RF noise measurements such as FIG. 2A-2E are performed, for example, 100 times and an average value thereof is calculated, an average RF noise level may be expressed as shown in FIG. 2F.

Conventionally, frequency values of clock signals transmitted to the data driver 120 are the same, and thus, as illustrated in FIG. 2, noise components illustrated in the respective graphs may be generated at the same frequency values (for example, f1, f1+Δf, f1+2Δf, and f1+3Δf). That is, since frequency components corresponding to RF noise are not dispersed, there is a limitation in lowering a level of average RF noise.

According to an embodiment of the present invention, the timing controller 130 may have a clock generating unit (not shown) for generating first to nth clock signals (n is a natural number of 2 or greater).

Here, the first to nth clock signals may have different frequency values.

The first to nth clock signals may be input to the data driver 120 as clock signal CLK3, and may be input as different clock signals whenever a preset frame number has lapsed.

On the other hand, in the present disclosure, for convenience in description, supply of the signal in which the data clock signal corresponding to the first to nth clock signals is embedded therein, supply of a signal having the first to nth clock signals embedded in the clock training data, and supply of the first to nth clock signals, may all be referred to as supplying a clock signal to the data driver 120.

According to embodiments of the present invention, for example, in a case in which the preset number of frames is 4 frames, when four frames have elapsed (i.e. a time equal to four frame periods has passed) since a first clock signal was supplied, a second clock signal is supplied, and when four frames have elapsed since the second clock signal was supplied, a third clock signal may be supplied. That is, successive clock signals are supplied every four frames.

Here, in a case in which the number of clock signals generated by the clock generating unit totals 3, when four frames have elapsed after the third clock signal was supplied, the first clock signal is supplied again, and this process may be repeatedly performed.

That is, the first clock signal, the second clock signal, the third clock signal, the first clock signal, the second clock signal, and the third clock signal may be sequentially and repeatedly supplied.

According to another embodiment, when the number of clock signals generated by the clock generating unit totals 3, when four frames have elapsed after the third clock signal was supplied, a second clock signal may be supplied.

That is, a first clock signal, a second clock signal, a third clock signal, a second clock signal, a first clock signal, a second clock signal, a third clock signal, and a second clock signal may be sequentially and repeatedly supplied. In other words, a second clock signal may be inserted between every sequence of first through third clock signals.

The first clock signal to nth clock signal may be embedded in at least any one of the image data signal RGB or the clock training data, and supplied to the data driver 120.

FIGS. 3A-3F are graphs illustrating RF noise generated when different clock signals are input to the data driver according to an embodiment of the present invention.

The graphs illustrated in FIGS. 3A-3F may be frequency domain graphs in which the x axis is frequency (Hz) and the y axis is power (dBm).

Figure 3A:
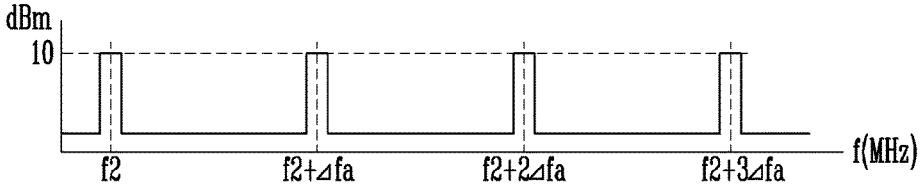
FIGS. 3A, 3B, 3C, 3D, 3E, and 3F are frequency domain graphs illustrating RF noise regarding an embodiment of the present invention.
Figure 3B:
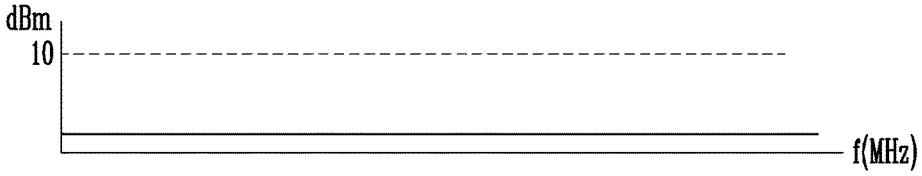

FIG. 3A is a graph illustrating a frequency component corresponding to RF noise as a first RF noise measurement result, FIG. 3B is a graph illustrating a frequency component corresponding to RF noise as a second RF noise measurement result, and FIGS. 3A and 3B were measured while a first clock signal having, in particular, an fa frequency value was supplied.

Figure 3C:
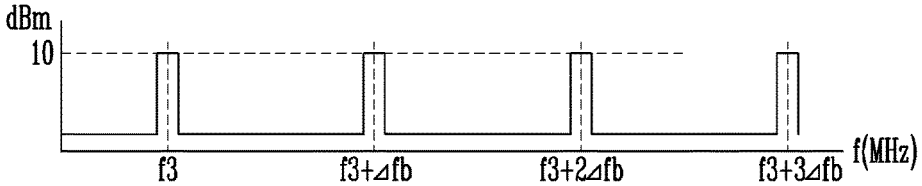
Figure 3D:
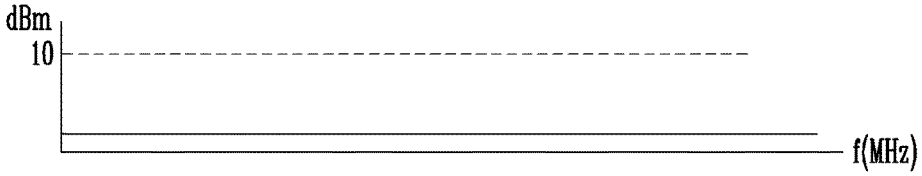

Also, FIG. 3C is a graph illustrating a frequency component corresponding to RF noise as a third RF noise measurement result, FIG. 3D is a graph illustrating a frequency component corresponding to RF noise as a fourth RF noise measurement result, and FIGS. 3C and 3D were measured while a second clock signal having frequency fb was being supplied.

Figure 3E:
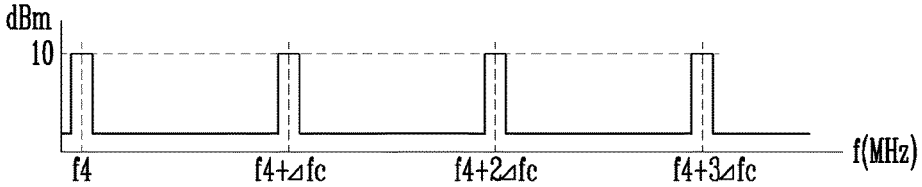

Also, FIG. 3E is a graph illustrating a frequency component corresponding to RF noise as a fifth RF noise measurement result, which was measured while a third clock signal having, in particular, frequency fc was being supplied.

On the other hand, RF noise may not always be generated whenever it is measured, and thus, it is assumed that a measurable noise component was not detected in the second and fourth measurements.

Figure 3F:
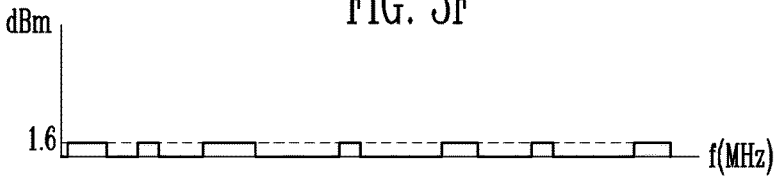

When the RF noise measurement is repeated 100 times, for example, and an average value thereof is calculated, the graph as illustrated FIG. 3F may be obtained.

In this case, first to third clock signals were sequentially alternately supplied as described above.

That is, according to the present invention, as illustrated in FIG. 3, since the frequency components corresponding to the RF noise are dispersed within the x axis of the frequency domain, an effect of lowering the average RF noise level may be obtained.

In comparison of average RF noise levels of FIG. 2F and FIG. 3F, when the clock signals (clock signals having different frequency values) supplied for every preset frame number are changed, an average RF noise level may be lowered to about 33%.

According to embodiments of the present invention, as the types of generated clock signals are increased, that is, as the n value is increased, the average RF noise level may be lowered.

For example, as described above with reference to FIGS. 2 and 3, when it is assumed that an average of 100 RF noise level measurements is calculated and every two measurements find no noise, Table 1 below may be obtained.

Referring to Table 1 below, as the number of clock signals supplied to the data driver 120 is increased, an average RF noise level is lowered. Particularly, as compared to a clock signal whose frequency value is held constant (i.e. only one unique clock signal is used), when ten or more clock signals having ten or more different frequency values are supplied, an average RF noise level may be lowered by 90% or more.

TABLE 1

| Number of clock signals | Average RF noise level |
|---|---|
| 1 | 100% |
| 2 | 50% |

TABLE 1-continued

| Number of clock signals | Average RF noise level |
|---|---|
| 3 | 33% |
| 4 | 25% |
| 5 | 20% |
| 6 | 17% |
| 7 | 14% |
| 8 | 13% |
| 9 | 11% |
| 10 | 10% |
| 11 | 9% |
| 12 | 8% |
| 13 | 8% |
| 14 | 7% |
| 15 | 7% |

Next, in a case in which n number of clock signals are generated, a difference between a frequency value of an (i−1)th clock signal and a frequency value of an ith clock signal may be a (i is a natural number equal to or greater than 2 and smaller than or equal to n).

For example, in a case in which a difference between a frequency value of a first clock signal and a frequency value of a second clock signal is a, a difference between a frequency value of the second clock signal and a frequency value of a third clock signal may also be a.

As the difference between the frequency value of the (i−1)th clock signal and the frequency value of the ith clock signal is increased, an average RF noise level may be reduced.

Hereinafter, the aforementioned effect will be described in detail through comparison between Table 2 and Table 3.

Figure 4:
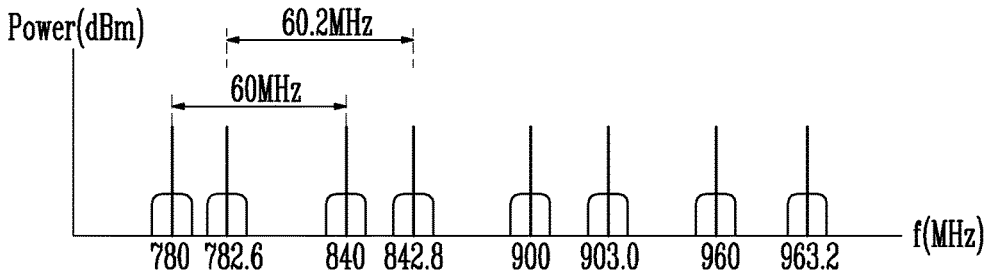
FIG. 4 is a graph in which part of Table 2 is illustrated in the frequency domain.
Figure 5:
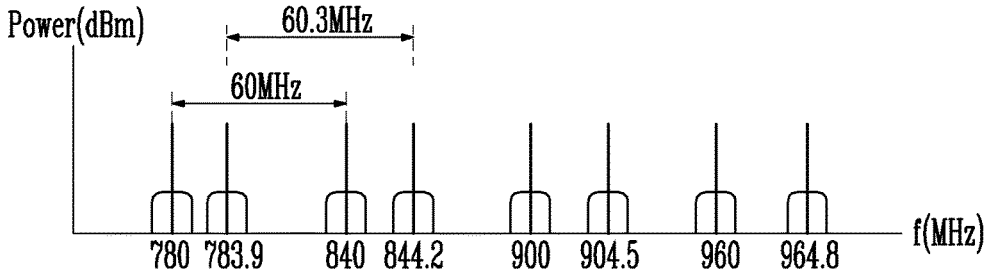
FIG. 5 is a graph in which part of Table 3 is illustrated in the frequency domain.

FIG. 4 is a frequency domain representation of part of Table 2, and FIG. 5 is a frequency domain representation of part of Table 3.

Table 2 illustrates a case in which a frequency value of a first clock signal is 60 MHz, a frequency value of a second clock signal is 60. 2 MHz, and thus, a difference between the frequency values of the first clock signal and the second clock signal is 0.2 MHz.

FIG. 4 is a view illustrating frequency components corresponding to frequency multiplication ratios 13 to 16 in a frequency domain. Frequency bands according to the frequency multiplication ratios 13 to 16 may be a predetermined critical wireless wide area network (WWAN) issue band.

In particular, in FIG. 4, narrow band signals of the frequency components corresponding to the frequency multiplication ratios 13 to 16, and broadband signals (or spread spectrums) obtained by modulating the narrowband signals, are illustrated together.

TABLE 2

| | Embedded clock signal reference | | |
|---|---|---|---|
| Frequency multiplication ratio | First embedded clock signal A (MHz) | Second embedded clock signal B (MHz) | B − A (MHz) |
| 1 | 60 | 60.2 | 0.2 |
| 13 | 780 | 782.6 | 2.6 |
| 14 | 840 | 842.8 | 2.8 |
| 15 | 900 | 903.0 | 3.0 |
| 16 | 960 | 963.2 | 3.2 |
| 17 | 1020 | 1023.4 | 3.4 |

As illustrated in FIG. 4, when each of the first clock signal and the second clock signal is multiplied k times (13 times to 16 times in FIG. 4) and displayed as frequency functions with a single frequency domain, and here, when frequency components corresponding to the first clock signal and the second clock signal are spread spectrums having a predetermined bandwidth, the first clock signal and the second clock signal may be generated such that frequency components corresponding to the first clock signal and the second clock signal do not overlap each other.

That is, in a case in which a value obtained by k times the difference between the frequencies of the first clock signal and the second clock signal, e.g. 13×2.6 (see Table 2) is greater than bandwidths of spread spectrums corresponding to the respective frequency components, the respective frequency components may not overlap each other.

Table 3 illustrates a case in which a frequency value of the first clock signal is 60 MHz, a frequency value of the second clock signal is 60.3 MHz, and thus, a difference between the frequency values of the first clock signal and the second clock signal is 0.3 MHz.

Like FIG. 4, FIG. 5 illustrates frequency components corresponding to the frequency multiplication ratios 13 to 16 in Table 3 in the frequency domain.

In particular, in FIG. 5, narrow band signals of the frequency components corresponding to the frequency multiplication ratios 13 to 16, and broadband signals obtained by modulating the narrowband signals, are illustrated together.

TABLE 3

| | Embedded clock signal | | |
|---|---|---|---|
| Frequency multiplication ratio | First embedded clock signal A (MHz) | Second embedded clock signal B (MHz) | B − A (MHz) |
| 1 | 60 | 60.3 | 0.3 |
| 13 | 780 | 783.9 | 3.9 |
| 14 | 840 | 844.2 | 4.2 |
| 15 | 900 | 904.5 | 4.5 |
| 16 | 960 | 964.8 | 4.8 |
| 17 | 1020 | 1025.1 | 5.1 |

Referring to FIGS. 4 and 5, as a (B-A) value is increased, a distance between the center frequencies of the frequency components in the frequency domain is increased.

Thus, even though a bandwidth of a modulated broadband signal is wide, a probability that broadband signals of the respective frequency components overlap each other may be lowered, and even though the broadband signals overlap each other, an overlap area may be reduced as the (B-A) value is increased. Thus, as the (B-A) value is increased, average RF noise level may be reduced.

Next, while an (i−1)th clock signal is being supplied, when the predetermined number of frame periods has passed and a supplied clock signal is changed to the ith clock signal, the changed ith clock signal may be supplied to a vertical blank section of a predetermined frame.

That portion of a frame in which effective image data is not transmitted may be divided into a vertical blank section and a horizontal blank section. In detail, the vertical blank section may be a section in which effective image data is not transmitted in part where a frame is changed in transmitting image data, and the horizontal blank section may be a section in which effective image data is not transmitted between one scanning line and a next scanning line.

The scan signal may not be supplied during the vertical blank section. For example, in the case where n scan lines are connected to the scan driver 110, of each frame period, the section from when the first scan signal is supplied until when the $n^{th}$ scan signal is supplied may be an active section. In such a case, the vertical blank section may be from when the active period ends until when each frame period ends.

Each section may be initiated by a vertical synchronization signal Vsync or a horizontal synchronization signal Hsync.

In a case in which a clock signal input to the data driver 120 is changed, that is, in a case in which a frequency value of a clock signal is changed, a receiving unit (not shown) of the data driver 120 fails to recognize the changed clock signal as a clock signal, generating a screen display error.

In detail, as a frequency value of a clock signal is changed, a problem in which the receiving unit of the data driver 120 is unlocked from a locked state, and a locked state between a transmitting unit (not shown) of the timing controller 130 and the receiving unit of the data driver 120 is released, may arise.

According to the present invention, since a frequency of a clock signal embedded in clock training data supplied in a vertical blank section is first changed before a frequency value of an active section in which effective image data is supplied, even though a locked state of the receiving unit of the data driver 120 is released, a locked state in the vertical blank section may be recovered. Thus, a screen display error may be prevented.

In the present invention, a plurality of clock signals each having a different frequency value, rather than a clock signal having a fixed frequency value, are used, and frequency components corresponding to RF noise may be dispersed to lower an average RF noise level.

Also, according to the present invention, since unnecessary data transmission is prevented to satisfy an RF noise standard, that is, since an increase in a data rate is prevented, an increase in current consumption may be restrained.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims. Various features of the above described and other embodiments can be mixed and matched in any manner, to produce further embodiments consistent with the invention.

What is claimed is:

1. A display device comprising:

a timing controller configured to receive an image data signal and a plurality of clock signals, and to generate a scan clock signal and a plurality of data clock signals;

a scan driver configured to receive the scan clock signal; and a data driver configured to receive the data clock signals, wherein the plurality of clock signals includes first to nth clock signals, and the plurality of data clock signals includes first to nth data clock signals generated from the first to nth clock signals (n is a natural number having a value of 2 or greater), the first to nth clock signals having frequencies different from each other and the first to nth data clock signals having frequencies different from each other, wherein whenever a predetermined number of frame periods has elapsed, the timing controller halts transmission of one of the first to nth data clock signals to the data driver, and begins transmission of another one of the first to nth data clock signals to the data driver, and wherein when k times each of the first clock signal to the nth clock signal (k is a natural number having a value of 2 or greater) is displayed as a function of frequency and frequency components corresponding to the first clock signal to the nth clock signal are displayed as a spread spectrum having a predetermined band width, the timing controller is configured to generate the first clock signal to the nth clock signal such that the frequency components corresponding to the first clock signal to the nth clock signal do not overlap each other.

2. The display device of claim 1, wherein each frame period includes a horizontal blank section that is a section during which effective image data is not transmitted between immediately successive scanning lines, and also includes a vertical blank section between immediately successive frame periods, and wherein the timing controller is configured to change the data clock signal in the vertical blank section.

3. The display device of claim 2, wherein the timing controller is further configured to generate clock training data, and wherein when the one of the data clock signals is generated from an ith clock signal (i is any one of a natural number from 1 to n), the timing controller is configured to embed the ith clock signal in the clock training data and to transmit the clock training data in the vertical blank section.

4. The display device of claim 3, wherein the ith data clock signal is generated by embedding the ith clock signal in the image data signal.

5. The display device of claim 3, wherein when the predetermined number of frame periods has passed since the ith data clock signal was supplied to the data driver, the timing controller is configured to transmit an (i+1)th data clock signal to the data driver, and when i=n, the timing controller is configured to transmit the first data clock signal as the (i+1)th data clock signal.

6. The display device of claim 3, wherein a difference between a frequency value of the ith clock signal and a frequency value of the (i+1)th clock signal remains uniform when i is changed.

7. The display device of claim 3, wherein, when n is greater than 2, the timing controller is configured to transmit an (i+1)th data clock signal to the data driver upon passing of the predetermined number of frame periods, and the timing controller is configured to transmit an (n−1)th data clock signal as the (i+1)th data clock signal when i=n.

8. The display device of claim 7, wherein when i=n and the (n−1) data clock signal is transmitted as the ith data clock signal, the timing controller is configured to transmit the data clock signals such that the value i is sequentially decremented to 1.

9. The display device of claim 1, wherein a value obtained by k times a difference value between a frequency value of the first clock signal and a frequency value of the second clock signal is equal to or greater than a value of the predetermined bandwidth.

10. A display device comprising:

a display panel including a plurality of pixels connected to scanning lines and data lines;

a timing controller configured to receive an image data signal and a plurality of clock signals, and to generate and transmit a scan clock signal and a plurality of data clock signals;

a scan driver configured to generate a scan signal with reference to the scan clock signal, and to supply the generated scan signal to the scanning lines; and a data driver configured to generate data signals with reference to the data clock signals, and to supply the generated data signals to the data lines, wherein the plurality of clock signals includes first to nth clock signals, and the plurality of data clock signals includes first to nth data clock signals generated from the first to nth (n is a natural number having a value of 2 or greater) clock signals, wherein the timing controller is configured to change the data clock signal transmitted to the data driver whenever a predetermined number of frame periods has passed, and wherein when k times each of the first clock signal to the nth clock signal (k is a natural number having a value of 2 or greater) is displayed as a function of frequency and frequency components corresponding to the first clock signal to the nth clock signal are displayed as a spread spectrum having a predetermined band width, the timing controller is configured to generate the first clock signal to the nth clock signal such that the frequency components corresponding to the first clock signal to the nth clock signal do not overlap each other.

11. The display device of claim 10, wherein each frame period includes:

a horizontal blank section that is a section during which effective image data is not transmitted between successive scanning lines, and a vertical blank section between immediately successive frame periods, wherein the timing controller is configured to change the data clock signal in the vertical blank section.

12. The display device of claim 11, wherein the timing controller is further configured to generate clock training data, and wherein when the one of the data clock signals is generated from an ith clock signal (i is any one of a natural number from 1 to n), the timing controller is configured to embed the ith clock signal in the clock training data and to transmit the clock training data in the vertical blank section.

13. The display device of claim 12, wherein when a data clock signal having a frequency value different from that of a data clock signal transmitted in a previous frame is input to the vertical blank section to cause an unlocked state, the data driver is configured to recover the unlocked state to a locked state during the vertical blank section.

* * * * *